US010935912B1

(12) United States Patent
Yokoyama

(10) Patent No.: US 10,935,912 B1
(45) Date of Patent: Mar. 2, 2021

(54) HEATING DEVICE HAVING FIRST AND SECOND HEAT TRANSFER UNITS FOR AN IMAGE FORMING UNIT

(71) Applicant: TOSHIBA TEC KABUSHIKI KAISHA, Tokyo (JP)

(72) Inventor: Shuji Yokoyama, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/817,509

(22) Filed: Mar. 12, 2020

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01); *G03G 2215/2035* (2013.01)

(58) Field of Classification Search
CPC ..... G03G 15/2053; G03G 2215/2035
USPC ..... 399/329; 219/216
See application file for complete search history.

(56) References Cited

U.S. PATENT DOCUMENTS

| | | | | |
|---|---|---|---|---|
| 9,599,940 | B2 * | 3/2017 | Yamano | G03G 15/2053 |
| 10,095,165 | B2 * | 10/2018 | Ogawa | G03G 15/2053 |
| 2002/0020693 | A1 * | 2/2002 | Otsuka | G03G 15/2053 219/216 |
| 2014/0186077 | A1 * | 7/2014 | Lee | G03G 15/2017 399/329 |
| 2018/0364625 | A1 * | 12/2018 | Yagi | G03G 15/2053 |
| 2019/0339638 | A1 * | 11/2019 | Kinukawa | G03G 15/2057 |
| 2019/0361379 | A1 * | 11/2019 | Koyama | G03G 15/2057 |
| 2020/0004183 | A1 * | 1/2020 | Yabuki | G03G 15/2053 |
| 2020/0033774 | A1 * | 1/2020 | Shinji | G03G 15/2053 |
| 2020/0133179 | A1 * | 4/2020 | Fukamachi | G03G 15/2057 |

FOREIGN PATENT DOCUMENTS

| | | | | |
|---|---|---|---|---|
| JP | 2013068724 A | * | 4/2013 | |
| JP | 2015-079202 A | | 4/2015 | |
| JP | 2015145950 A | * | 8/2015 | |
| JP | 2016095397 A | * | 5/2016 | G03G 15/2042 |
| JP | 2016161849 A | * | 9/2016 | |
| JP | 2019091028 A | * | 6/2019 | |

* cited by examiner

*Primary Examiner* — Robert B Beatty
(74) *Attorney, Agent, or Firm* — Foley & Lardner LLP

(57) ABSTRACT

According to one embodiment, a heating device includes a cylindrical body, a heater unit, a support member, a first heat transfer unit, and a second heat transfer unit. The cylindrical body has a film shape. The heater unit is disposed inside the cylindrical body. In the heater unit, the axial direction of the cylindrical body is taken as a longitudinal direction. The support member supports the heater unit. The first heat transfer unit is disposed between the inner surface of the cylindrical body and the heater unit. The first heat transfer unit abuts on a first surface of the heater unit. The second heat transfer unit is disposed between the heater unit and the support member. The second heat transfer unit abuts on a second surface of the heater unit opposite to the first surface.

17 Claims, 7 Drawing Sheets

HEATING DEVICE HAVING FIRST AND SECOND HEAT TRANSFER UNITS FOR AN IMAGE FORMING UNIT

FIELD

Embodiments described herein relate generally to a heating device and an image processing apparatus.

BACKGROUND

An image forming apparatus can be used to form an image on a sheet. The image forming apparatus can be an image processing apparatus. The image forming apparatus includes a heating device for fixing toner (recording agent) to a sheet. The heating device includes a cylindrical body and a heater unit. The cylindrical body has a film shape. The heater unit is disposed inside the cylindrical body. In the heater unit, the axial direction of the cylindrical body is taken as a longitudinal direction. When a sheet passing through the heating device is heated, a temperature distribution is generated in the heater unit according to the size of the sheet. The heating device is required to distribute the temperature distribution of the heater unit.

DETAILED DESCRIPTION

In general, according to one embodiment, a heating device includes a cylindrical body, a heater unit, a support member, a first heat transfer unit, and a second heat transfer unit. The cylindrical body has a film shape. The heater unit is disposed inside the cylindrical body. In the heater unit, the axial direction of the cylindrical body is taken as a longitudinal direction. The support member supports the heater unit. The first heat transfer unit is disposed between the inner surface of the cylindrical body and the heater unit. The first heat transfer unit abuts on a first surface of the heater unit. The second heat transfer unit is disposed between the heater unit and the support member. The second heat transfer unit abuts on a second surface of the heater unit opposite to the first surface.

Hereinafter, a heating device and an image processing apparatus according to an embodiment will be described with reference to the drawings.

Figure 1:
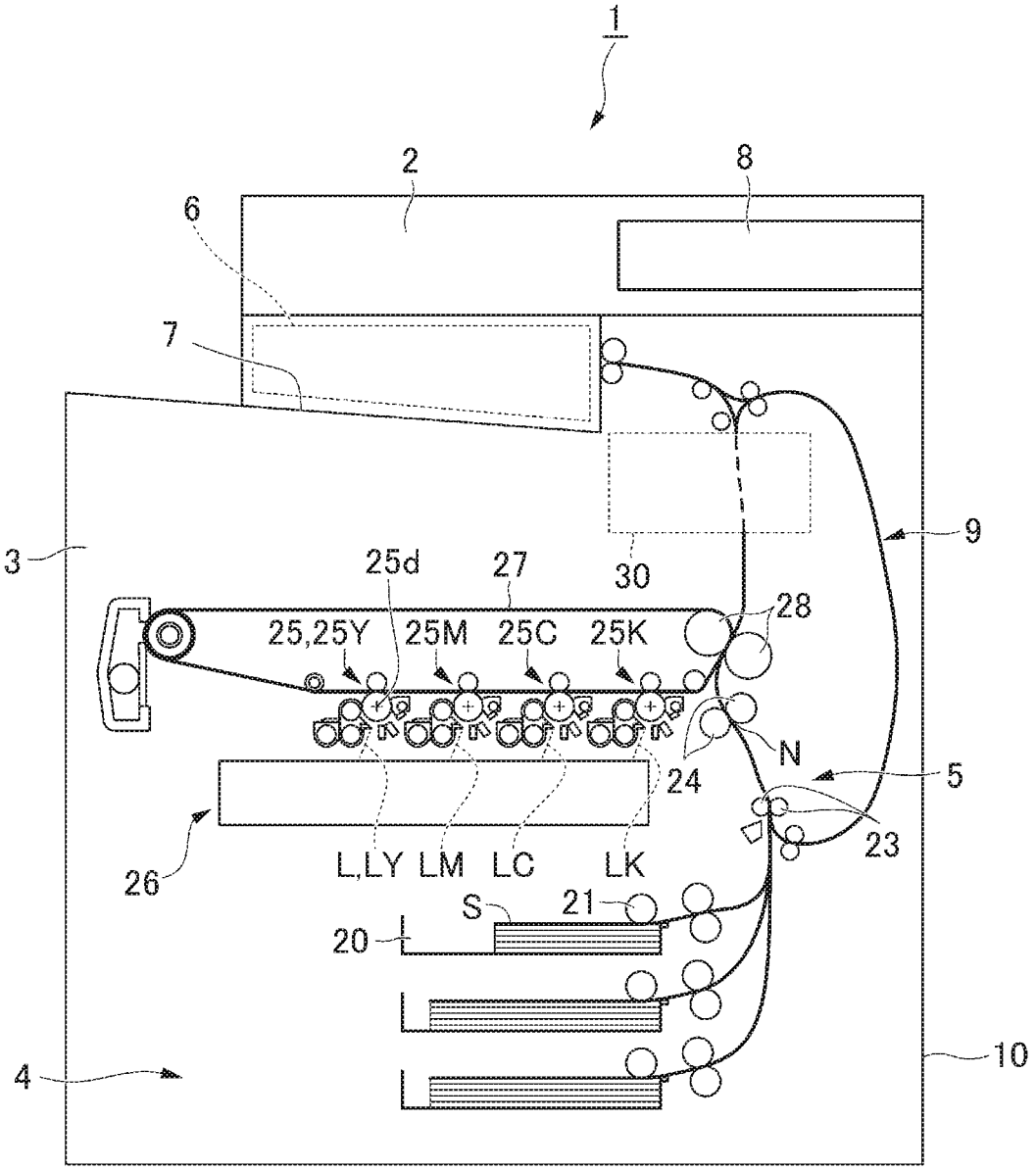
FIG. 1 is a schematic configuration diagram of an image processing apparatus according to an embodiment.

FIG. 1 is a schematic configuration diagram of the image processing apparatus according to the embodiment.

The image processing apparatus according to the embodiment is an image forming apparatus 1. The image forming apparatus 1 performs a process of forming an image on a sheet (paper) S. In various embodiments, the sheet S is a sheet of paper, such as printer paper.

The image forming apparatus 1 includes a housing 10, a scanner unit 2, an image forming unit 3, a sheet supply unit 4, a conveyance unit 5, a sheet discharge tray 7, a reversing unit 9, a control panel 8, and a control unit 6.

The housing 10 forms the outer shape of the image forming apparatus 1. For example, the housing 10 may enclose (e.g., encapsulate, surround, cover, etc.) various other components of the image forming apparatus 1 such as the scanner unit 2, the image forming unit 3, the sheet supply unit 4, the conveyance unit 5, the sheet discharge tray 7, the reversing unit 9, the control panel 8, or the control unit 6.

The scanner unit 2 reads (obtains) image information of an object to be copied as light contrast, and generates an image signal. The scanner unit 2 outputs the generated image signal to the image forming unit 3.

The image forming unit 3 forms an output image (hereinafter referred to as a toner image) by a recording agent such as toner based on the image signal received from the scanner unit 2 or an image signal received from the outside, such as from an external device or via a network. The image forming unit 3 transfers the toner image onto the front surface of the sheet S. The image forming unit 3 heats and pressurizes the toner image on the front surface of the sheet S to fix the toner image on the sheet S. Details of the image forming unit 3 will be described later.

The sheet supply unit 4 supplies sheets S to the conveyance unit 5 one by one in accordance with the timing at which the image forming unit 3 forms a toner image. The sheet supply unit 4 includes a sheet storage unit 20 and a pickup roller 21.

The sheet storage unit 20 stores sheets S having a predetermined size (target size) and type (target type).

The pickup roller 21 picks up the sheets S from the sheet storage unit 20 one by one. The pickup roller 21 supplies the picked-up sheet S to the conveyance unit 5.

The conveyance unit 5 conveys the sheet S supplied from the sheet supply unit 4 to the image forming unit 3. The conveyance unit 5 includes a conveyance roller 23 and a registration roller 24.

The conveyance roller 23 conveys the sheet S supplied from the pickup roller 21 to the registration roller 24. The conveyance roller 23 abuts the front end of the sheet S in the conveyance direction against a nip N of the registration rollers 24.

The registration roller 24 adjusts the position of the front end of the sheet S in the conveyance direction by bending the sheet S at the nip N. The registration roller 24 conveys the sheet S in accordance with the timing at which the image forming unit 3 transfers the toner image to the sheet S. The image forming unit 3 will be described.

The image forming unit 3 includes a plurality of image forming sections 25, a laser scanning unit 26, an intermediate transfer belt 27, a transfer unit 28, and a fixing device 30 (heating device).

The image forming section 25 includes a photosensitive drum 25*d*. The image forming section 25 forms a toner image corresponding to the image signal from the scanner unit 2 or the outside on the photosensitive drum 25*d*. A plurality of image forming sections 25Y, 25M, 25C, and 25K form toner images with yellow, magenta, cyan, and black toners, respectively.

A charger, a developing device, and the like are disposed around the photosensitive drum 25*d*. The charger charges the front surface of the photosensitive drum 25*d*. The developing device contains a developer including yellow, magenta, cyan, and black toners. The developing device develops an electrostatic latent image on the photosensitive drum. 25*d*. As a result, a toner image is formed with a toner of each color on the photosensitive drum 25*d*.

The laser scanning unit 26 scans the charged photosensitive drum 25*d* with a laser beam L to expose (activate) the photosensitive drum 25*d*. The laser scanning unit 26 exposes the photosensitive drums 25*d* of the image forming sections 25Y, 25M, 25C, and 25K of the respective colors with different laser beams LY, LM, LC, and LK. As a result, the laser scanning unit 26 forms an electrostatic latent image on the photosensitive drum 25*d*. The toner image on the front surface of the photosensitive drum 25*d* is primarily transferred onto the intermediate transfer belt 27.

The transfer unit 28 transfers the toner image primarily transferred onto the intermediate transfer belt 27 onto the front surface of the sheet S at a secondary transfer position.

The fixing device 30 heats and pressurizes the toner image transferred onto the sheet S to fix the toner image to the sheet S. Details of the fixing device 30 will be described later. The reversing unit 9 reverses (flips) the sheet S in order to form an image on the back surface of the sheet S. The reversing unit 9 reverses the sheet S discharged from the fixing device 30 with a switch mechanism (switch back). The reversing unit 9 conveys the reversed sheet S toward the registration roller 24.

The sheet discharge tray 7 receives the sheet S on which an image is formed and provides the sheet S for discharge from the image forming apparatus 1.

The control panel 8 is a part of an input unit for inputting information for an operator to operate the image forming apparatus 1. The control panel 8 includes a touch panel and various hard keys.

The control unit 6 controls each unit of the image forming apparatus 1. Details of the control unit 6 will be described later.

Figure 2:
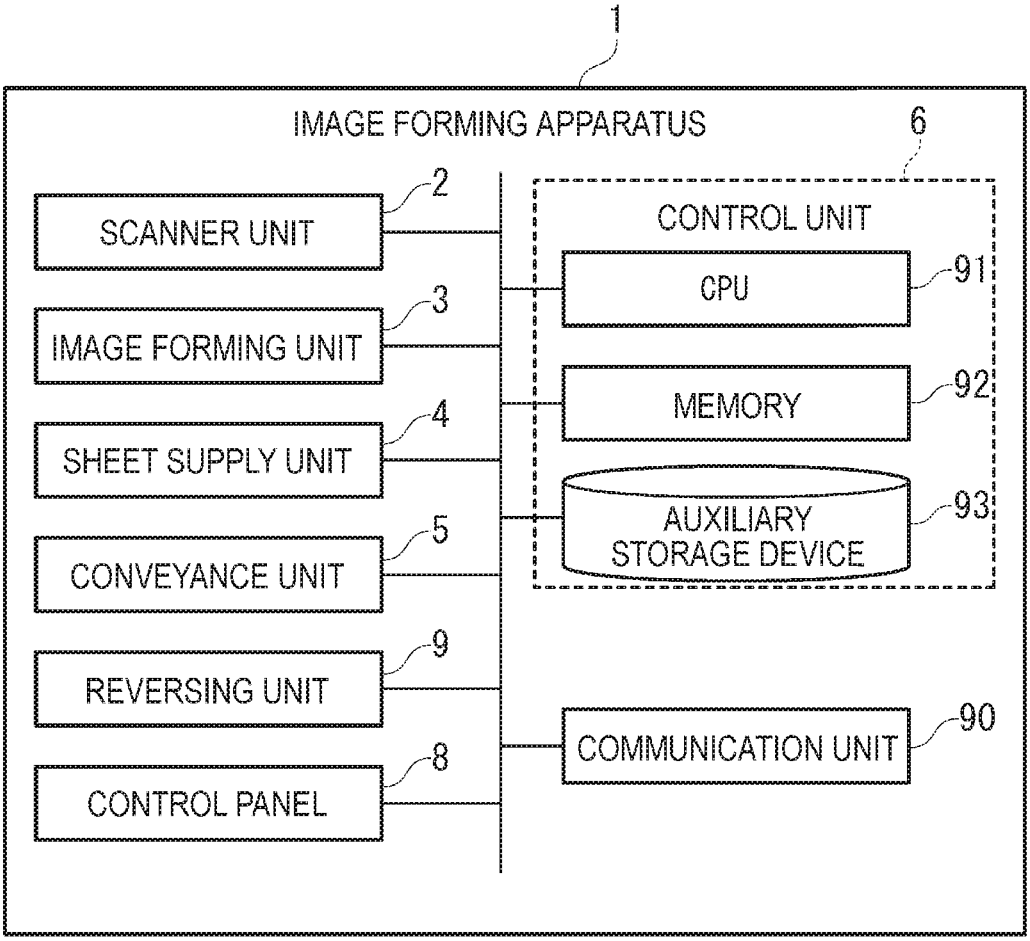
FIG. 2 is a hardware configuration diagram of the image processing apparatus.

FIG. 2 is a hardware configuration diagram of the image processing apparatus according to the embodiment. The image forming apparatus 1 includes a central processing unit (CPU) 91, a memory 92, an auxiliary storage device 93, and the like, which are connected by a bus. The image forming apparatus 1 executes a program. The image forming apparatus 1 functions as an apparatus including the scanner unit 2, the image forming unit 3, the sheet supply unit 4, the conveyance unit 5, the reversing unit 9, the control panel 8, and a communication unit 90 by executing a program.

The CPU 91 functions as the control unit 6 by executing a program stored in the memory 92 and/or the auxiliary storage device 93. The control unit 6 controls the operation of each functional component of the image forming apparatus 1, such as the scanner unit 2, the image forming unit 3, the sheet supply unit 4, the conveyance unit 5, the reversing unit 9, the control panel 8, and the communication unit 90.

The auxiliary storage device 93 may include a storage device such as a magnetic hard disk device or a semiconductor storage device. The auxiliary storage device 93 stores information, such as programs.

The communication unit 90 includes a communication interface for connecting the image forming apparatus 1 to an external device. The communication unit 90 communicates with an external device via the communication interface.

The fixing device 30 will be described in detail.

Figure 3:
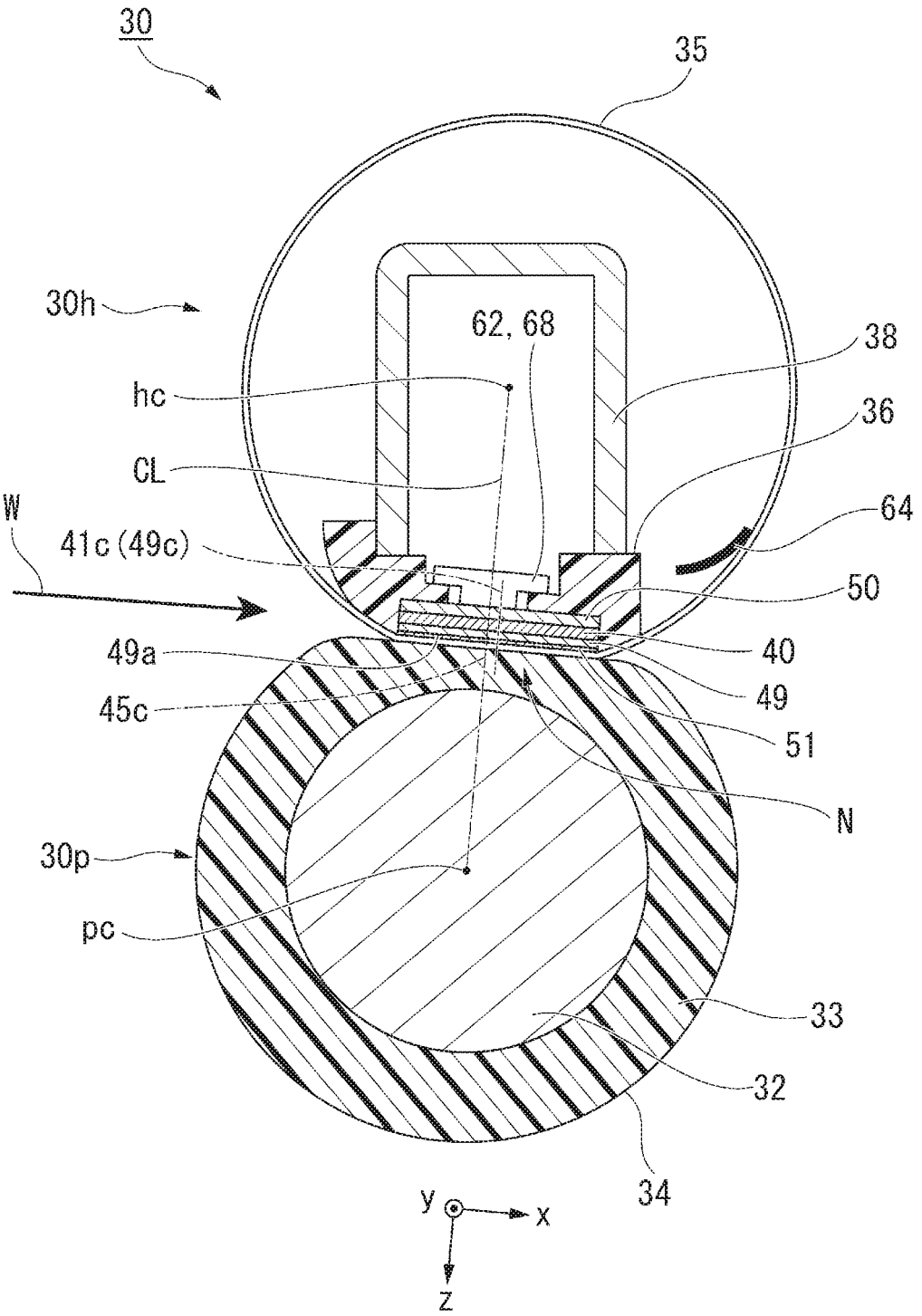
FIG. 3 is a front cross-sectional view of a heating device.

FIG. 3 is a front cross-sectional view of a heating device according to the embodiment. The heating device according to the embodiment is the fixing device 30. The fixing device 30 includes a pressure roller 30*p* and a film unit 30*h*.

The pressure roller 30*p* forms the nip N with the film unit 30*h*.

The pressure roller 30*p* pressurizes the toner image of the sheet S that entered the nip N. The pressure roller 30*p* rotates and conveys the sheet S. The pressure roller 30*p* includes a cored bar 32, an elastic layer 33, and a release layer 34.

The cored bar 32 is formed of a metal material such as stainless steel in a cylindrical shape. Both end portions in the axial direction of the cored bar 32 are rotatably supported. The cored bar 32 is rotationally driven by a motor (not shown). The cored bar 32 abuts on a cam member (not shown). The cam member rotates and moves the cored bar 32 toward and away from the film unit 30*h*.

The elastic layer 33 is formed of an elastic material such as silicone rubber. The elastic layer 33 is formed on the outer peripheral surface of the cored bar 32 with a constant thickness.

The release layer 34 is formed of a resin material such as perfluoroalkoxy (PFA) (such as tetrafluoroethylene/perfluoroalkyl vinyl ether copolymer). The release layer 34 is formed on the outer peripheral surface of the elastic layer 33.

For example, when the outer diameter of the pressure roller 30*p* is 20 millimeters (mm) to 40 mm, it is preferable that the outer diameter of the cored bar 32 is set to 10 mm to 20 mm, the thickness of the elastic layer 33 is set to 5 mm to 20 mm, and the thickness of the release layer 34 is set to 20 micrometers (μm) to 40 μm. The hardness of the outer peripheral surface of the pressure roller 30*p* is desirably 40° to 70° at a load of 9.8 N, as measured with an ASKER-C hardness meter. Thereby, the area of the nip N and the durability of the pressure roller 30*p* are ensured. The pressure roller 30*p* can be brought into contact with and separated from the film unit 30*h* by a link mechanism using a cam, for example. When the pressure roller 30*p* is brought into contact with the film unit 30*h* and pressed by a pressure spring, the nip N is formed. On the other hand, when the sheet S is jammed in the fixing device 30, the sheet S can be removed by separating the pressure roller 30*p* from the film unit 30*h*. In addition, in a state where a cylindrical film 35 is stopped from rotating, such as during sleep, the cylindrical film 35 is prevented from being plastically deformed by separating the pressure roller 30*p* from the film unit 30*h*.

The pressure roller 30*p* is rotationally driven by a motor and rotates. When the pressure roller 30*p* rotates in a state where the nip N is formed, the cylindrical film 35 of the film unit 30*h* is driven to rotate. The pressure roller 30*p* conveys the sheet S in a conveyance direction W by rotating in a state where the sheet S is disposed at the nip N.

The film unit 30*h* heats the toner image of the sheet S that entered the nip N. The film unit 30*h* includes the cylindrical film 35 (cylindrical body), a heater unit 40, a first heat absorbing (e.g., soaking, etc.) member 49 (first heat transfer unit), a second heat absorbing member 50 (second heat transfer unit), a lubricating layer 51, a support member 36, a stay 38, a heater thermometer 62, a thermostat 68, and a film thermometer 64. The cylindrical film 35 is formed in (rolled into) a cylindrical shape. The cylindrical film 35 includes abase layer, an elastic layer, and a release layer in order from the inner peripheral side. The base layer is formed of a material such as nickel (Ni) in a cylindrical shape. The elastic layer is laminated on the outer peripheral surface of the base layer. The elastic layer is formed of an elastic material such as silicone rubber. The release layer is laminated on the outer peripheral surface of the elastic layer. The release layer is formed of a material such as PFA resin.

In order to shorten a warm-up time, it is preferable to set the thicknesses of the elastic layer and the release layer so that the respective heat capacities are not too large. For example, when the inner diameter of the cylindrical film 35 is 20 mm to 40 mm, the thickness of the base layer may be set to 30 μm to 50 μm, the thickness of the elastic layer may be set to 100 μm to 300 μm, and the thickness of the release layer may be set to 20 μm to 40 μm. A coat (for example, a fluorine coat) may be applied to the inner side of the base layer in order to improve the frictional slidability with the first heat absorbing member 49.

Figure 4:
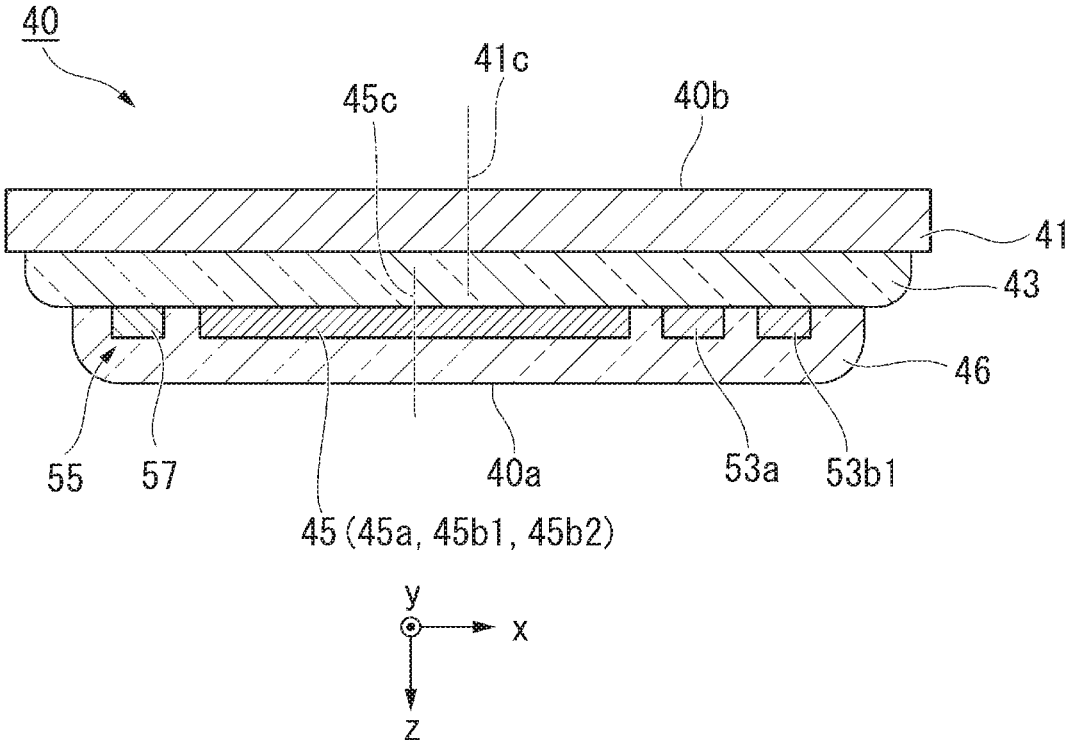
FIG. 4 is a front cross-sectional view of a heater unit.
Figure 5:
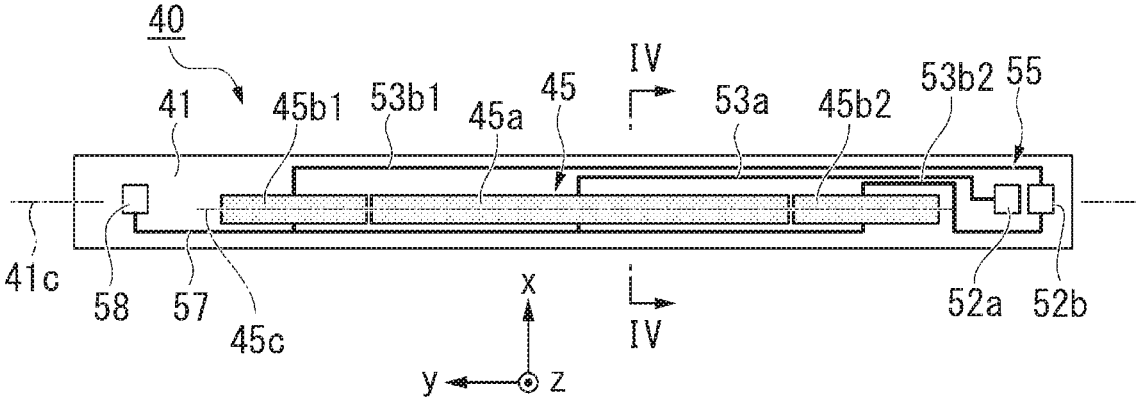
FIG. 5 is a bottom view of the heater unit.

FIG. 4 is a front cross-sectional view of the heater unit taken along line IV-IV in FIG. 5. FIG. 5 is a bottom view of the heater unit (viewed from the +z-direction). The heater unit 40 includes a substrate 41 (heating element substrate), a heating element set 45, and a wiring set 55.

The substrate 41 is formed of a metal material such as stainless steel or a ceramic material such as aluminum nitride. The substrate 41 is formed in along and thin rectangular plate shape. The substrate 41 is disposed inside the cylindrical film 35 in the radial direction. In the substrate 41, the axial direction of the cylindrical film 35 is taken as a longitudinal direction. In other words, a central axis of the cylindrical film 35 (around which the cylindrical film 35 extends) is orthogonal to a central axis of the substrate 41.

In the present application, the x-direction, the y-direction, and the z-direction are defined as follows.

The y-direction is the longitudinal direction of the substrate 41 (heater unit 40). As will be described later, the +y-direction is a direction from a central heating element 45*a* toward a first end heating element 45*b*1.

The x-direction is the short direction of the substrate 41. The +x-direction is the conveyance direction (downstream direction) of the sheet S.

The z-direction is the normal direction of the substrate 41. The +z-direction is a direction in which the heating element set 45 is disposed with respect to the substrate 41. An insulating layer 43 is formed of a glass material or the like on the surface of the substrate 41 in the +z-direction. The surface of the heater unit 40 in the +z-direction (first surface 40*a*) faces the inner peripheral surface of the cylindrical film (see FIG. 3) across the first heat absorbing member 49. The heating element set 45 is disposed on the substrate 41. The heating element set 45 is formed on the surface of the insulating layer 43 in the +z-direction as shown in FIG. 4. The heating element set 45 is formed of silver/palladium alloy or the like. The outer shape of the heating element set 45 is formed in a rectangular shape in which the y-direction is the longitudinal direction and the x-direction is the short direction.

As shown in FIG. 5, the heating element set 45 includes a plurality of heating elements 45*b*1, 45*a*, and 45*b*2 provided along the y-direction. The heating element set 45 includes the first end heating element 45*b*1, the central heating element 45*a*, and the second end heating element 45*b*2, which are disposed side by side in the y-direction.

The central heating element 45*a* is disposed at the center portion in the y-direction of the heating element set 45. The central heating element 45*a* may be configured by combining a plurality of small heating elements disposed side by side in the y-direction.

The first end heating element 45*b*1 is disposed in the +y-direction of the central heating element 45*a* and at the end portion in the +y-direction of the heating element set 45.

The second end heating element 45*b*2 is disposed in the −y-direction of the central heating element 45*a* and at the end portion in the −y-direction of the heating element set 45.

A boundary line between the central heating element 45*a* and the first end heating element 45*b*1 is disposed in parallel with the x-direction. The boundary line between the central heating element 45*a* and the first end heating element 45*b*1 may be disposed to intersect the x-direction. The same applies to the boundary line between the central heating element 45*a* and the second end heating element 45*b*2.

The heating element set 45 generates heat by electric conduction. The electric resistance value of the central heating element 45*a* is smaller than the electric resistance values of the first end heating element 45*b*1 and the second end heating element 45*b*2. The electrical resistance values of the first end heating element 45*b*1 and the second end heating element 45*b*2 are substantially the same. Here, the electrical resistance value of the central heating element 45*a* is a "central resistance value A", and the electrical resistance value of the first end heating element 45*b*1 (second end heating element 45*b*2) is an "end resistance value B". For example, the ratio (A:B) between the central resistance value A and the end resistance value B is preferably in the range of 3:1 to 7:1, and more preferably in the range of 4:1 to 6:1.

The sheet S having a small width in the y-direction passes through the center portion in the y-direction of the fixing device 30. In this case, the control unit 6 causes only the central heating element 45*a* to generate heat. On the other hand, the control unit 6 causes the entire heating element set 45 to generate heat when the sheet S has a large width in the y-direction. Therefore, the central heating element 45*a*, the first end heating element 45*b*1, and the second end heating element 45*b*2 are controlled to generate heat independently of each other. Further, the first end heating element 45*b*1 and the second end heating element 45*b*2 are similarly controlled in heat generation.

The wiring set 55 is formed of a metal material such as silver. The wiring set 55 includes a central contact 52*a*, a central wiring 53*a*, an end contact 52*b*, a first end wiring 53*b*1, a second end wiring 53*b*2, a common contact 58, and a common wiring 57. The central contact 52*a* is disposed in the −y-direction of the heating element set 45.

The central wiring 53*a* is disposed in the +x-direction of the heating element set 45. The central wiring 53*a* connects the +x-direction end of the central heating element 45*a* and the central contact 52*a* to each other.

The end contact 52*b* is disposed in the −y-direction of the central contact 52*a*.

The first end wiring 53*b*1 is disposed in the +x-direction of the heating element set 45 and in the +x-direction of the central wiring 53*a*. The first end wiring 53*b*1 connects the end in +x-direction of the first end heating element 45*b*1 and the end portion in +x-direction of the end contact 52*b* to each other.

The second end wiring 53*b*2 is disposed in the +x-direction of the heating element set 45 and in the −x-direction of the central wiring 53*a*. The second end wiring 53*b*2 connects the end in +x-direction of the second end heating element 45*b*2 and the end portion in −x-direction of the end contact 52*b* to each other.

The common contact 58 is disposed in the +y-direction of the heating element set 45.

The common wiring 57 is disposed in the −x-direction of the heating element set 45. The common wiring 57 connects the common contact point 58 to the −x-direction ends of the central heating element 45*a*, the first end heating element 45*b*1, and the second end heating element 45*b*2.

Thus, in the +x-direction of the heating element set 45, the second end wiring 53*b*2, the central wiring 53*a*, and the first end wiring 53*b*1 are disposed. On the other hand, only the common wiring 57 is disposed in the −x-direction of the heating element set 45. Therefore, a center 45*c* in the x-direction of the heating element set 45 is disposed in the −x-direction from a center 41*c* in the x-direction of the substrate 41.

As shown in FIG. 3, a straight line CL connecting a center pc of the pressure roller 30*p* and a center hc of the film unit 30*h* is defined. The center 41*c* in the x-direction of the substrate 41 is disposed in the +x-direction from the straight line CL. A center 49*c* in the x-direction of the first heat absorbing member 49 coincides with the center 41*c* in the x-direction of the substrate 41. The +x-direction end (the downstream end in the conveyance direction of the sheet S) of the first heat absorbing member 49 coincides with the +x-direction end of the substrate 41. As a result, since the first heat absorbing member 49 extends in the +x-direction of the nip N, the sheet S that passed through the nip N is easily released from the film unit 30*h*.

The center 45*c* in the x-direction of the heating element set 45 is disposed on the straight line CL. The heating element set 45 is entirely included in the region of the nip N and is disposed at the center of the nip N. Thereby, the heat distribution in the nip N becomes uniform, and the sheet S passing through the nip N is heated uniformly.

As shown in FIG. 4, the heating element set 45 and the wiring set 55 are formed on the surface of the insulating layer 43 in the +z-direction. A protective layer 46 is formed of a glass material or the like so as to cover the heating element set 45 and the wiring set 55. The protective layer 46 protects the heating element set 45 and the wiring set 55.

As shown in FIG. 3, the heater unit 40 is disposed inside the cylindrical film 35. The surface of the heater unit 40 in the +z-direction (see the first surface 40*a* in FIG. 4) faces the nip N across the first heat absorbing member 49.

In the first heat absorbing member 49, the axial direction of the cylindrical film 35 is taken as a longitudinal direction. In other words, a central axis of the cylindrical film 35 (around which the cylindrical film 35 extends) is orthogonal to a central axis of the heat absorbing member 49.

The first heat absorbing member 49 is formed in a rectangular plate shape. The outer shape of the first heat absorbing member 49 is equal to the outer shape of the substrate 41 of the heater unit 40. The first heat absorbing member 49 preferably has the same length as the substrate 41 of the heater unit 40 in the x-direction and the y-direction.

The first heat absorbing member 49 is disposed between the inner surface of the cylindrical film 35 and the heater unit 40. The first heat absorbing member 49 is disposed on the heating element set 45 side of the substrate 41 of the heater unit 40. The first heat absorbing member 49 is disposed in contact with the surface of the heater unit 40 in the +z-direction (see the first surface 40*a* in FIG. 4).

The first heat absorbing member 49 has a higher thermal conductivity than the substrate 41 of the heater unit 40. Additionally, the first heat absorbing member 49 has a higher thermal conductivity than the second heat absorbing member 50. For example, when the substrate 41 and the second heat absorbing member 50 are made of stainless steel, the first heat absorbing member 49 may be formed of a metal material such as copper or aluminum, or carbon. The thickness of the first heat absorbing member 49 is preferably equal to or less than the thickness of the second heat absorbing member 50.

In the second heat absorbing member 50, the axial direction of the cylindrical film 35 is taken as a longitudinal direction. In other words, a central axis of the cylindrical film 35 (around which the cylindrical film 35 extends) is orthogonal to a central axis of the second heat absorbing member 50.

The second heat absorbing member 50 is formed in a rectangular plate shape like the first heat absorbing member 49. The second heat absorbing member 50 is formed of a member different from the first heat absorbing member 49. For example, the first heat absorbing member 49 may be structurally separate from the second heat absorbing member 50 such that the first heat absorbing member 49 is separable from the second heat absorbing member 50. The outer shape of the second heat absorbing member 50 is equal to the outer shape of the substrate 41 of the heater unit 40. The second heat absorbing member 50 preferably has the same length as the substrate 41 of the heater unit 40 in the x-direction and the y-direction.

The second heat absorbing member 50 is disposed between the heater unit 40 and the support member 36. The second heat absorbing member 50 is disposed on the opposite side to the heating element set 45 side of the substrate 41 of the heater unit 40. The second heat absorbing member 50 is disposed in contact with the surface of the heater unit 40 in the −z-direction (see the second surface 40*b* in FIG. 4).

The second heat absorbing member 50 has a higher thermal conductivity than the substrate 41 of the heater unit 40. The second heat absorbing member 50 has a lower thermal conductivity than the first heat absorbing member 49. For example, when the substrate 41 is made of stainless steel and the first heat absorbing member 49 is made of copper, the second heat absorbing member 50 may be formed of a metal material such as aluminum. A contact area A2 between the second heat absorbing member 50 and the support member 36 is smaller than a contact area A1 between the first heat absorbing member 49 and the heater unit (A2<A1). The contact surface (the surface in the −z-direction) with the heater unit 40 in the first heat absorbing member 49 is a flat surface. The contact surface (the surface in the −z-direction) with the support member 36 in the second heat absorbing member 50 is a flat surface.

The lubricating layer 51 is disposed between the inner surface of the cylindrical film 35 and the first heat absorbing member 49. For example, the lubricating layer 51 may be a fluorine coat formed on the surface of the first heat absorbing member 49 in the +z-direction (first surface 49*a*). The lubricating layer 51 is formed over the entire first surface 49*a* of the first heat absorbing member 49. As a result, relatively movement between the first heat absorbing member 49 and the cylindrical film 35 is facilitated.

The thickness of the lubricating layer 51 is preferably set so as not to hinder the transfer of heat from the heater unit 40 to the cylindrical film 35 as much as possible. For example, the thickness of the lubricating layer 51 is preferably set to 1 μm or more and 100 μm or less.

Grease (not shown) may be applied to the inner peripheral surface of the cylindrical film 35. In this case, the grease is disposed between the lubricating layer 51 (see FIG. 3) and the inner peripheral surface of the cylindrical film 35. The first heat absorbing member 49 is in contact with the inner peripheral surface of the cylindrical film 35 through the lubricating layer 51 and the grease. When the heater unit 40 generates heat, the viscosity of the grease decreases. Thus, the slidability between the first heat absorbing member 49 and the cylindrical film 35 is ensured.

The support member 36 is formed of an elastic material such as silicone rubber or fluorine rubber, or a resin material such as a polyimide resin, polyphenylene sulfide (PPS), polyethersulfone (PES), or a liquid crystal polymer. The support member 36 is disposed so as to cover the heater unit 40 in the −z-direction and both sides in the x-direction. The support member 36 supports the heater unit 40 via the second heat absorbing member 50. Round chamfers are formed at both end portions in the x-direction of the support member 36. The support member 36 supports the inner peripheral surface of the cylindrical film 35 at both end portions in the x-direction of the heater unit 40.

When the sheet S passing through the fixing device 30 is heated, a temperature distribution is generated in the heater unit 40 according to the size of the sheet S. When the heater unit 40 becomes locally high in temperature, there is a possibility that the temperature exceeds the heat resistance temperature of the support member 36 formed of a resin material. The second heat absorbing member 50 distributes the temperature produced by the heater unit 40. Thus, the support member 36 is protected from relatively high temperatures.

The stay 38 is formed of a steel plate material or the like. A cross section perpendicular to the y-direction of the stay 38 is formed in a U-shape. For example, the stay 38 may be formed by bending a steel material having a plate thickness of 1 mm to 3 mm. The stay 38 is mounted in the −z-direction of the support member 36 so as to close the U-shaped opening with the support member 36. The stay 38 extends in the y-direction. Both end portions in the y-direction of the stay 38 are fixed to the housing of the image forming apparatus 1. Thus, the film unit 30*h* is supported by the image forming apparatus 1. The stay 38 improves the bending rigidity of the film unit 30*h*. Near both end portions in the y-direction of the stay 38, flanges (not shown) that restrict the movement of the cylindrical film 35 in the y-direction are mounted.

The heater thermometer 62 is disposed in the −z-direction of the heater unit 40 with the second heat absorbing member 50 sandwiched therebetween. For example, the heater thermometer 62 may be a thermistor. The heater thermometer 62 is mounted and supported on the surface of the support member 36 in the −z-direction. The temperature sensing element of the heater thermometer 62 contacts the second heat absorbing member 50 through a hole penetrating the support member 36 in the z-direction. The heater thermometer 62 measures the temperature of the heater unit 40 via the second heat absorbing member 50.

The thermostat 68 is disposed in the same manner as the heater thermometer 62. The thermostat 68 is incorporated in an electric circuit described later. The thermostat 68 cuts off the electric conduction to the heating element set 45 when the temperature of the heater unit 40 detected via the second heat absorbing member 50 exceeds a predetermined temperature (target temperature).

Figure 6:
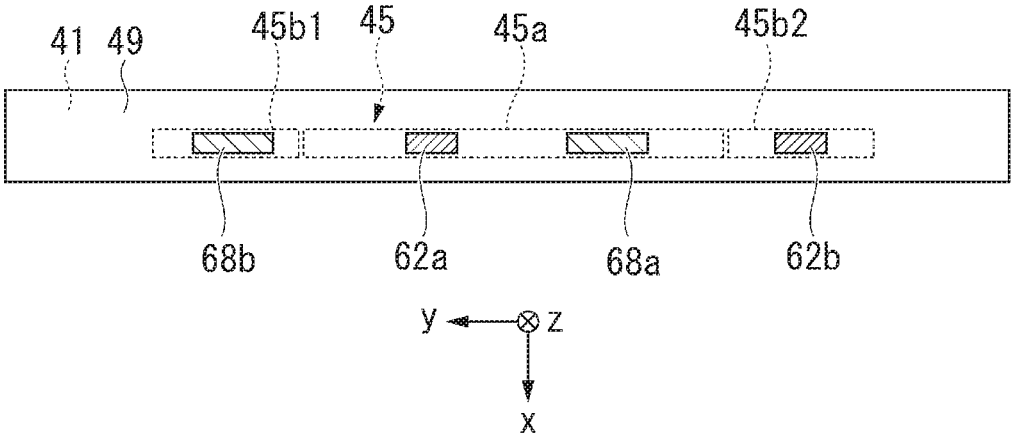
FIG. 6 is a plan view of a heater thermometer and a thermostat.

FIG. 6 is a plan view of the heater thermometer and the thermostat (viewed from the −z-direction). In FIG. 6, the illustration of the support member 36 is omitted. In addition, the following description regarding the arrangement of the heater thermometer, the thermostat, and the film thermometer demonstrates the arrangement of each temperature sensing element.

A plurality of heater thermometers 62 (62*a* and 62*b*) are disposed side by side in the y-direction. The plurality of heater thermometers 62 are disposed on the heating element set 45. The plurality of heater thermometers 62 are disposed within a range in the y-direction of the heating element set 45. The plurality of heater thermometers 62 are disposed at the center in the x-direction of the heating element set 45. That is, when viewed from the z-direction, the plurality of heater thermometers 62 and the heating element set 45 overlap at least partially.

The plurality of thermostats 68 (68*a* and 68*b*) are also disposed in the same manner as the plurality of heater thermometers 62 described above.

The plurality of heater thermometers 62 include a central heater thermometer 62*a* and an end heater thermometer 62*b* (a thermometer disposed on one side in the longitudinal direction).

The central heater thermometer 62*a* measures the temperature of the central heating element 45*a*. The central heater thermometer 62*a* is disposed within the range of the central heating element 45*a*. That is, when viewed from the z-direction, the central heater thermometer 62*a* and the central heating element 45*a* overlap.

The end heater thermometer 62*b* measures the temperature of the second end heating element 45*b*2. As described above, the first end heating element 45*b*1 and the second end heating element 45*b*2 are similarly controlled in heat generation. Therefore, the temperature of the first end heating element 45*b*1 is equal to the temperature of the second end heating element 45*b*2. The end heater thermometer 62*b* is disposed within the range of the second end heating element 45*b*2. That is, when viewed from the z-direction, the end heater thermometer 62*b* and the second end heating element 45*b*2 overlap each other.

The plurality of thermostats 68 include a central thermostat 68*a* and an end thermostat 68*b*.

The central thermostat 68*a* cuts off the electric conduction to the heating element set 45 when the temperature of the central heating element 45*a* exceeds a predetermined temperature (target temperature). The central thermostat 68*a* is disposed within the range of the central heating element 45*a*. That is, when viewed from the z-direction, the central thermostat 68*a* and the central heating element 45*a* overlap each other.

The end thermostat 68*b* cuts off the electric conduction to the heating element set 45 when the temperature of the first end heating element 45*b*1 exceeds a predetermined temperature (target temperature). As described above, the first end heating element 45*b*1 and the second end heating element 45*b*2 are similarly controlled in heat generation. Therefore, the temperature of the first end heating element 45*b*1 is equal to the temperature of the second end heating element 45*b*2. The end thermostat 68*b* is disposed within the range of the first end heating element 45*b*1. That is, when viewed from the z-direction, the end thermostat 68*b* and the first end heating element 45*b*1 overlap each other.

As described above, the central heater thermometer 62*a* and the central thermostat 68*a* are disposed on the central heating element 45*a*. Thus, the temperature of the central heating element 45*a* is measured. Further, when the temperature of the central heating element 45*a* exceeds a predetermined temperature (target temperature), the electric conduction to the heating element set 45 is cut off.

The end heater thermometer 62*b* is disposed on the second end heating element 45*b*2 (end heating element). Thus, the temperature of the second end heating element 45*b*2 is measured. Since the temperature of the first end heating element 45*b*1 is equal to the temperature of the second end heating element 45*b*2, the temperatures of the first end heating element 45*b*1 and the second end heating element 45*b*2 are measured.

The end thermostat 68*b* is disposed on the first end heating element 45*b*1. When the temperatures of the first end heating element 45*b*1 and the second end heating element

45*b*2 exceed a predetermined temperature (target temperature), the electric conduction to the heating element set 45 is cut off.

The plurality of heater thermometers 62 and the plurality of thermostats 68 are alternately disposed in parallel along the y-direction. As described above, the first end heating element 45*b*1 is disposed in the +y-direction of the central heating element 45*a*. The end thermostat 68*b* is disposed within the range of the first end heating element 45*b*1. The central heater thermometer 62*a* is disposed in the +y-direction from the center in the y-direction of the central heating element 45*a*. The central thermostat 68*a* is disposed in the −y-direction from the center in the y-direction of the central heating element 45*a*. As described above, the second end heating element 45*b*2 is disposed in the −y-direction of the central heating element 45*a*. The end heater thermometer 62*b* is disposed within the range of the second end heating element 45*b*2. Thus, the end thermostat 68*b*, the central heater thermometer 62*a*, the central thermostat 68*a*, and the end heater thermometer 62*b* are disposed side by side in this order from the +y-direction to the −y-direction. In general, the thermostat 68 connects (completes) and disconnects (interrupts) an electric circuit by using a deformation of a curved bimetal element which is caused by a temperature change of the bimetal element. The thermostat is formed long and thin in accordance with the shape of the bimetal. Further, the terminals extend outward from both end portions in the longitudinal direction of the thermostat 68. An external wiring connector is connected to this terminal by caulking. Therefore, it is necessary to secure a space outside the thermostat 68 in the longitudinal direction. Since the fixing device 30 has no space in the x-direction, the longitudinal direction of the thermostat 68 is disposed along the y-direction. At this time, if the plurality of thermostats 68 are disposed adjacent to each other in the y-direction, it is difficult to secure a connection space for external wiring.

As described above, the plurality of heater thermometers 62 and the plurality of thermostats 68 are alternately disposed in parallel along the y-direction. Accordingly, the heater thermometer 62 is disposed adjacent to the thermostat 68 in the y-direction. Therefore, a connection space for external wiring to the thermostat 68 can be secured. Moreover, the degree of freedom of the layout in the y-direction of the thermostat 68 and the heater thermometer 62 increases. As a result, the thermostat 68 and the heater thermometer 62 can be disposed at optimal positions, and the temperature of the fixing device 30 can be controlled. Further, it is easy to separate the alternating current wiring connected to the plurality of thermostats 68 and the direct current wiring connected to the plurality of heater thermometers 62 from each other. Thus, the generation of noise in an electric circuit is suppressed. The film thermometer 64 is disposed inside the cylindrical film 35 and in the +x-direction of the heater unit 40, as shown in FIG. 3. The film thermometer 64 contacts the inner peripheral surface of the cylindrical film 35 and measures the temperature of the cylindrical film 35.

Figure 7:
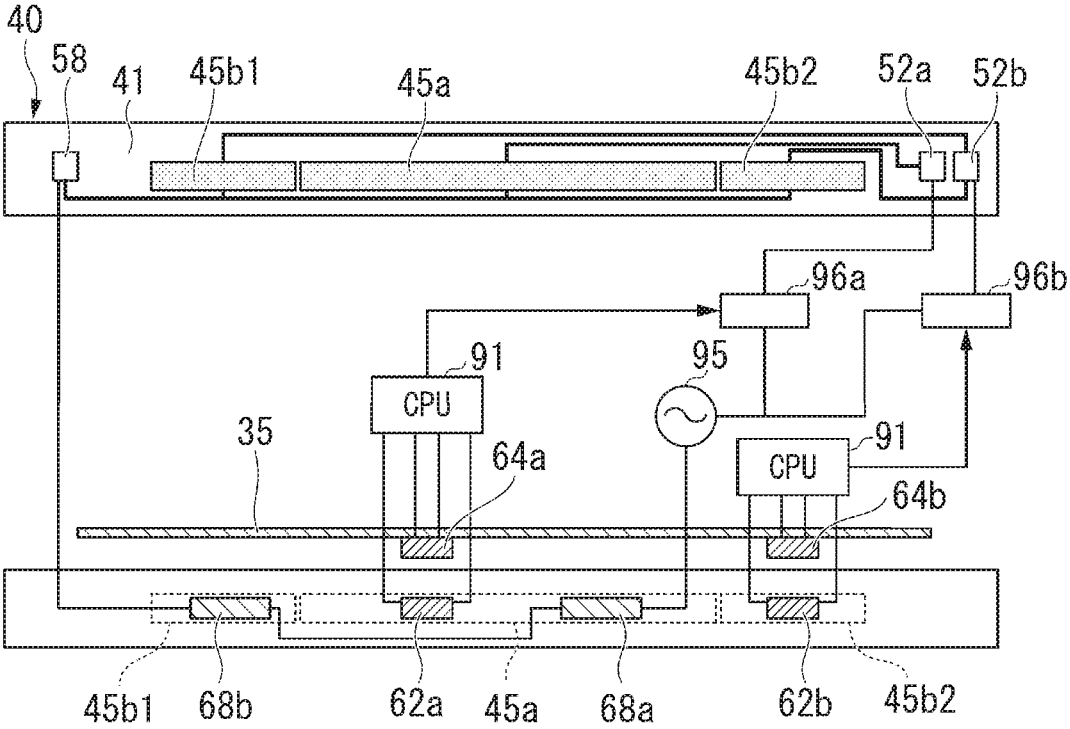
FIG. 7 is an electric circuit diagram of the heating device.

FIG. 7 is an electric circuit diagram of the heating device according to the embodiment. In FIG. 7, the bottom view of FIG. 5 is disposed on the upper side of the page and the plan view of FIG. 6 is disposed on the lower side of the page. In FIG. 7, a plurality of film thermometers 64 along with the cross section of the cylindrical film 35 are illustrated above the plan view on the lower side. The plurality of film thermometers include a central film thermometer 64*a* and an end film thermometer 64*b* (a thermometer disposed on one side in the longitudinal direction).

The central film thermometer 64*a* contacts the center portion in the y-direction of the cylindrical film 35. The central film thermometer 64*a* contacts the cylindrical film 35 within the range in the y-direction of the central heating element 45*a*. The central film thermometer 64*a* measures the temperature of the center portion in the y-direction of the cylindrical film 35.

The end film thermometer 64*b* contacts the end portion in the −y-direction of the cylindrical film 35. The end film thermometer 64*b* contacts the cylindrical film 35 within the range in the y-direction of the second end heating element 45*b*2. The end film thermometer 64*b* measures the temperature of the end portion in the −y-direction of the cylindrical film 35. As described above, the first end heating element 45*b*1 and the second end heating element 45*b*2 are similarly controlled in heat generation. Therefore, the temperature of the end portion in the −y-direction of the cylindrical film 35 is equal to the temperature of the end portion in the +y-direction.

A power supply 95 is connected to the central contact 52*a* via a central triac 96*a*. The power supply 95 is connected to the end contact 52*b* via an end triac 96*b*. The CPU 91 controls ON and OFF of the central triac 96*a* and the end triac 96*b* independently of each other. When the CPU 91 turns on the central triac 96*a*, power is supplied from the power supply 95 to the central heating element 45*a*. As a result, the central heating element 45*a* generates heat. When the CPU 91 turns on the end triac 96*b*, power is supplied from the power supply 95 to the first end heating element 45*b*1 and the second end heating element 45*b*2. As a result, the first end heating element 45*b*1 and the second end heating element 45*b*2 generate heat. As described above, the central heating element 45*a*, the first end heating element 45*b*1, and the second end heating element 45*b*2 are controlled to generate heat independently of each other. The central heating element 45*a*, the first end heating element 45*b*1, and the second end heating element 45*b*2 are connected in parallel to the power supply 95.

The power supply 95 is connected to the common contact 58 via the central thermostat 68*a* and the end thermostat 68*b*. The central thermostat 68*a* and the end thermostat 68*b* are connected in series.

When the temperature of the central heating element 45*a* rises abnormally, the detected temperature of the central thermostat 68*a* exceeds a predetermined temperature (target temperature). At this time, the central thermostat 68*a* cuts off the electric conduction from the power supply 95 to the entire heating element set 45.

When the temperature of the first end heating element 45*b*1 rises abnormally, the detected temperature of the end thermostat 68*b* exceeds a predetermined temperature (target temperature). At this time, the end thermostat 68*b* cuts off the electric conduction from the power supply 95 to the entire heating element set 45. As described above, the first end heating element 45*b*1 and the second end heating element 45*b*2 are similarly controlled in heat generation. Therefore, when the temperature of the second end heating element 45*b*2 rises abnormally, the temperature of the first end heating element 45*b*1 rises similarly. Therefore, when the temperature of the second end heating element 45*b*2 rises abnormally, the end thermostat 68*b* similarly cuts off the electric conduction from the power supply 95 to the entire heating element set 45.

The CPU 91 (control unit 6) measures the temperature of the central heating element 45*a* with the central heater thermometer 62*a*. The CPU 91 measures the temperature of the second end heating element 45*b*2 with the end heater thermometer 62*b*. The temperature of the second end heating element 45*b*2 is equal to the temperature of the first end heating element 45*b*1. The CPU 91 measures the temperature of the heating element set 45 with the heater thermometer 62 when the fixing device 30 is started. When the temperature of the heating element set 45 is lower than a predetermined temperature (target temperature), the CPU 91 causes the heating element set 45 to generate heat only for a short time. Thereafter, the CPU 91 starts to rotate the pressure roller 30*p*. Due to the heat generated by the heating element set 45, the viscosity of the grease applied to the inner peripheral surface of the cylindrical film 35 is reduced. Thus, the slidability between the first heat absorbing member 49 and the cylindrical film 35 at the time of starting the rotation of the pressure roller 30*p* is ensured.

The CPU 91 measures the temperature of the center portion in the y-direction of the cylindrical film 35 with the central film thermometer 64*a*. The CPU 91 measures the temperature of the end portion in the −y-direction of the cylindrical film 35 with the end film thermometer 64*b*. The temperature of the end portion in the −y-direction of the cylindrical film 35 is equal to the temperature of the end portion in the +y-direction of the cylindrical film 35. The CPU 91 measures the temperatures at the center portion and the end portion in the y-direction of the cylindrical film 35 when the fixing device 30 is in operation. The CPU 91 performs phase control or wave number control on the power supplied to the heating element set 45 by the central triac 96*a* and the end triac 96*b*. The CPU 91 controls the electric conduction to the central heating element 45*a* based on the temperature measurement result of the center portion in the y-direction of the cylindrical film 35. The CPU 91 controls the electric conduction to the first end heating element 45*b*1 and the second end heating element 45*b*2 based on the temperature measurement result of the end portion in the y-direction of the cylindrical film 35.

As described above, the fixing device 30 according to the embodiment includes the cylindrical film 35, the heater unit 40, the support member 36, the first heat absorbing member 49, and the second heat absorbing member 50. The cylindrical film 35 has a film shape. The heater unit 40 is disposed inside the cylindrical film 35. In the heater unit 40, the axial direction of the cylindrical film 35 is taken as the longitudinal direction. In other words, a central axis of the cylindrical film 35 (around which the cylindrical film 35 extends) is orthogonal to a central axis of the heater unit 40. The support member 36 supports the heater unit 40. The first heat absorbing member 49 is disposed between the inner surface of the cylindrical film 35 and the heater unit 40. The first heat absorbing member 49 abuts on the first surface 40*a* of the heater unit 40. The second heat absorbing member 50 is disposed between the heater unit 40 and the support member 36. The second heat absorbing member 50 abuts on the second surface 40*b* of the heater unit 40 opposite to the first surface 40*a*. With the above configuration, the following effects can be obtained.

The heater unit 40 is sandwiched between the first heat absorbing member 49 and the second heat absorbing member 50. Therefore, it is possible to suppress variation in the temperature distribution of the front and back surfaces (the first surface 40*a* and the second surface 40*b*) of the heater unit 40 in the longitudinal direction. Therefore, the heat produced by the heater unit 40 can be distributed.

As a result, it is possible to suppress damage to the cylindrical film 35 due to a temperature rise in the non-sheet passing area (the area where the sheet does not pass) and to suppress damage to the support member 36.

In addition, the heat produced by the heater unit 40 can be more effectively distributed as compared with the case where the heat absorbing member is disposed only on one of the first surface 40*a* and the second surface 40*b* of the heater unit 40. The first heat absorbing member 49 has a higher thermal conductivity than the second heat absorbing member 50. With the above configuration, the following effects can be obtained.

The heat of the heater unit 40 is easily transferred to the cylindrical film 35 and the heat of the heater unit 40 is not easily transferred to the support member 36. That is, the heat of the heater unit 40 is less likely to escape (dissipate) to the support member 36 side. Therefore, the heat produced by the heater unit 40 can be distributed without greatly deteriorating the temperature raising performance of the cylindrical film 35.

The first heat absorbing member 49 and the second heat absorbing member 50 have a higher thermal conductivity than the substrate 41 of the heater unit 40. With the above configuration, the following effects can be obtained.

Compared with the case where at least one of the first heat absorbing member 49 and the second heat absorbing member 50 has a thermal conductivity equal to or lower than the substrate 41 of the heater unit 40, the heat produced by the heater unit 40 can be more effectively distributed.

The heater unit 40 includes the substrate 41 and the heating elements 45*b*1, 45*a*, and 45*b*2 disposed on the surface of the substrate 41 facing the first heat absorbing member 49. With the above configuration, the following effects can be obtained.

Compared with the case where the first heat absorbing member 49 is disposed on the opposite side to the heating elements 45*b*1, 45*a*, and 45*b*2 of the substrate 41, the heat of the heating elements 45*b*1, 45*a*, and 45*b*2 is easily transferred to the cylindrical film 35. Therefore, the heat produced by the heater unit 40 can be distributed without greatly deteriorating the temperature raising performance of the cylindrical film 35.

The cylindrical film 35 forms the nip N with the pressure roller 30*p*. The heater unit 40 faces the nip N. With the above configuration, the following effects can be obtained.

Compared to the case where the heater unit 40 is disposed offset from the nip N, the heat distribution in the nip N tends to be uniform. Therefore, the sheet S passing through the nip N can be heated uniformly.

The fixing device 30 includes the lubricating layer 51 disposed between the inner surface of the cylindrical film 35 and the first heat absorbing member 49. With the above configuration, the following effects can be obtained.

The slidability between the first heat absorbing member 49 and the cylindrical film 35 can be ensured.

The thickness of the lubricating layer 51 is 1 μm or more and 100 μm or less. With the above configuration, the following effects can be obtained.

While ensuring the slidability between the first heat absorbing member 49 and the cylindrical film 35, it is possible to prevent the heat transfer from the heater unit 40 to the cylindrical film 35 from being hindered.

The contact area A2 between the second heat absorbing member 50 and the support member 36 is smaller than the contact area A1 between the first heat absorbing member 49 and the heater unit 40. With the above configuration, the following effects can be obtained.

Compared with the case of A2≥A1, the heat of the heater unit 40 is less likely to escape to the support member 36 side. Therefore, the heat produced by the heater unit 40 can be distributed without greatly deteriorating the temperature raising performance of the cylindrical film 35.

The first heat transfer unit is the plate-shaped first heat absorbing member 49 taking the axial direction of the cylindrical film 35 as a longitudinal direction. The second heat transfer unit is the plate-like second heat absorbing member 50 formed of a member different from the first heat absorbing member 49. With the above configuration, there is an effect that the thermal conductivity of the first heat transfer unit and the second heat transfer unit is easily set with a simple configuration.

The image forming apparatus 1 according to the embodiment includes the fixing device 30 described above.

The fixing device 30 can distribute the heat produced by the heater unit 40. Therefore, the image forming apparatus 1 can improve the image quality.

Next, a modification example of the embodiment will be described.

The first heat absorbing member 49 according to the embodiment has a higher thermal conductivity than the second heat absorbing member 50. On the other hand, the first heat absorbing member 49 may have a thermal conductivity equal to or lower than the second heat absorbing member 50.

The first heat absorbing member 49 according to the embodiment is disposed on the side of the heating elements 45*b*1, 45*a*, and 45*b*2 of the substrate 41. On the other hand, the first heat absorbing member 49 may be disposed on the opposite side to the side of the heating elements 45*b*1, 45*a*, and 45*b*2 of the substrate 41. In this case, the heating elements 45*b*1, 45*a*, and 45*b*2 are disposed in the −z-direction with respect to the substrate 41. The heater unit 40 according to the embodiment faces the nip N. On the other hand, the heater unit 40 may be disposed offset from the nip N. For example, the fixing device may include a nip forming unit (for example, a pad for forming the nip N) and a heating unit (for example, a heater unit disposed at a position different from the pad).

The fixing device 30 according to the embodiment includes the lubricating layer 51 disposed between the inner surface of the cylindrical film 35 and the first heat absorbing member 49. On the other hand, the fixing device 30 may not have the lubricating layer 51.

The thickness of the lubricating layer 51 according to the embodiment is 1 μm or more and 100 μm or less. On the other hand, the thickness of the lubricating layer 51 may be less than 1 μm or more than 100 μm. For example, the thickness of the lubricating layer 51 can be changed according to the required specifications.

The contact area A2 between the second heat absorbing member 50 and the support member 36 according to the embodiment is smaller than the contact area A1 between the first heat absorbing member 49 and the heater unit 40. On the other hand, the contact area A2 between the second heat absorbing member 50 and the support member 36 may be equal to or greater than the contact area A1 between the first heat absorbing member 49 and the heater unit 40.

Figure 8:
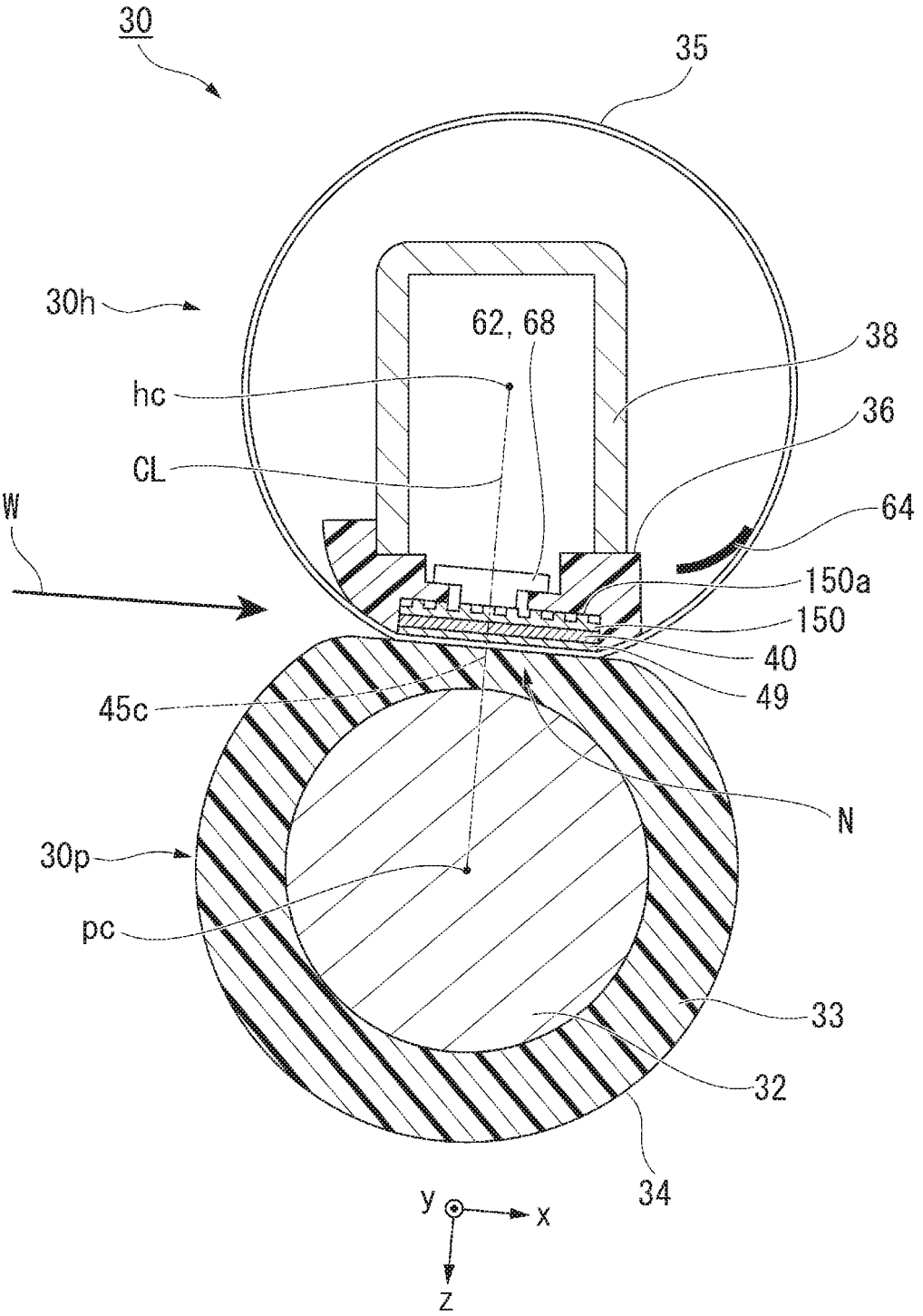
FIG. 8 is a front cross-sectional view of a heating device according to a first modification example of the embodiment.

In the second heat absorbing member 50 according to the embodiment, the contact surface (the surface in the −z-direction) with the support member 36 is a flat surface. On the other hand, the contact surface with the support member 36 in a second heat absorbing member 150 may be a surface which has an unevenness 150*a* (see FIG. 8). For example, the unevenness 150*a* may be formed over the entire surface of the second heat absorbing member 150 in the −z-direction. For example, the second heat absorbing member 150 may abut on the support member 36 by point contact or line contact.

Figure 9:
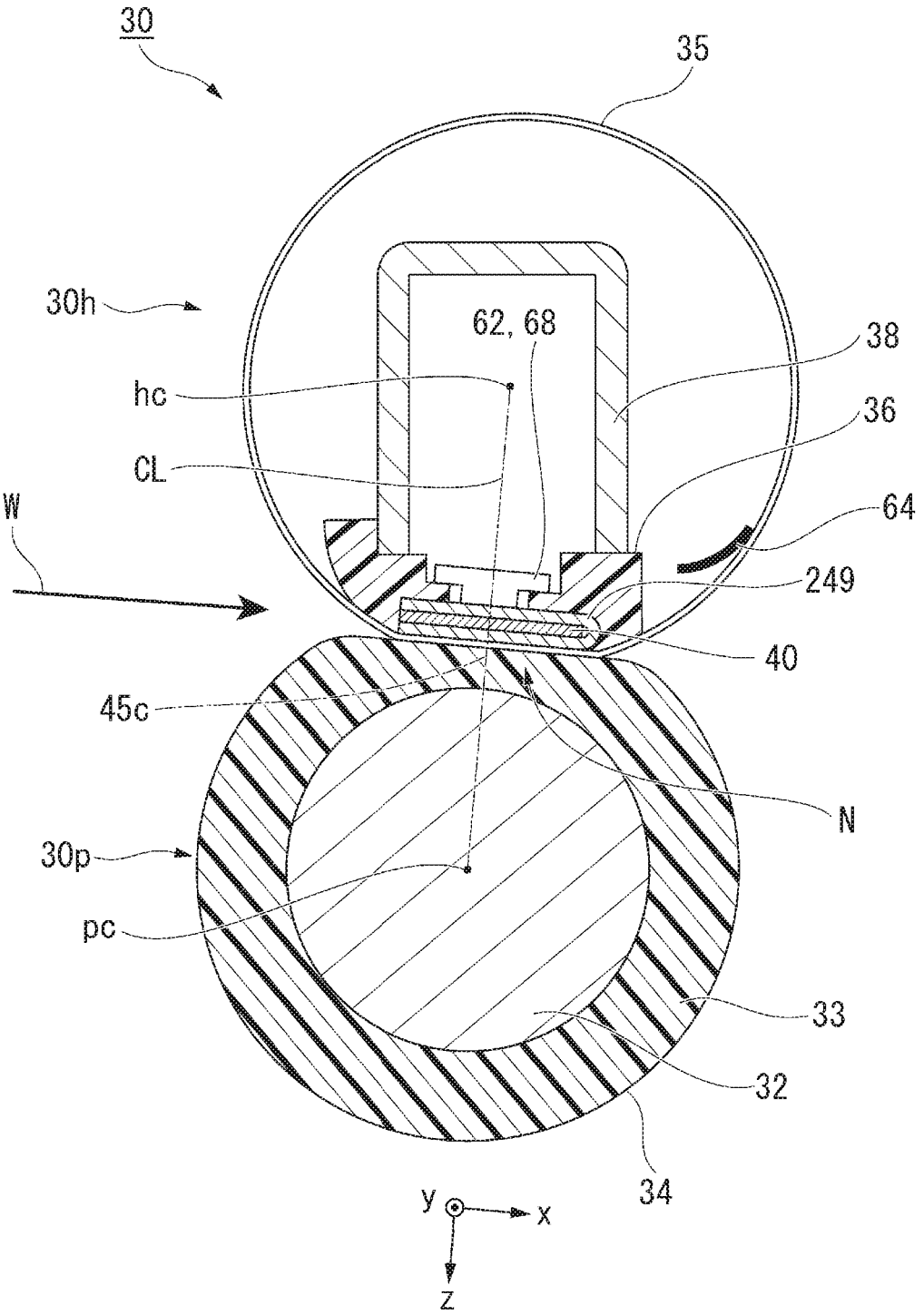
FIG. 9 is a front cross-sectional view of a heating device according to a second modification example of the embodiment.

The first heat transfer unit according to the embodiment is the plate-like first heat absorbing member 49 taking the axial direction of the cylindrical film 35 as a longitudinal direction. The second heat transfer unit is the plate-like second heat absorbing member 50 formed of a member different from the first heat absorbing member 49. On the other hand, the first heat transfer unit and the second heat transfer unit may be configured with a heat absorbing member 249 formed integrally with the same member (see FIG. 9). For example, the heat absorbing member 249 may have a U-shape that sandwiches the heater unit 40 when viewed from the axial direction of the cylindrical film 35. For example, the heat absorbing member 249 may be biased in a direction in which the heater unit 40 is sandwiched. According to this configuration, the heater unit 40 can be supported with a simple configuration.

The image processing apparatus according to the embodiment is the image forming apparatus 1, and the heating device is the fixing device 30. On the other hand, the image processing apparatus may be a decoloring apparatus, and the heating device may be a decoloring (erasing) unit. The decoloring apparatus performs a process of decoloring (erasing) an image formed on the sheet with the decoloring toner. The decoloring unit heats and decolors the decoloring toner image formed on the sheet passing through the nip.

According to at least one embodiment described above, the fixing device 30 includes the cylindrical film 35, the heater unit 40, the support member 36, the first heat absorbing member 49, and the second heat absorbing member 50. The cylindrical film 35 has a film shape. The heater unit 40 is disposed inside the cylindrical film 35. In the heater unit 40, the axial direction of the cylindrical film 35 is taken as the longitudinal direction. The support member 36 supports the heater unit 40. The first heat absorbing member 49 is disposed between the inner surface of the cylindrical film 35 and the heater unit 40. The first heat absorbing member 49 abuts on the first surface 40*a* of the heater unit 40. The second heat absorbing member 50 is disposed between the heater unit 40 and the support member 36. The second heat absorbing member 50 abuts on the second surface 40*b* of the heater unit 40 opposite to the first surface 40*a*. With the above configuration, the following effects can be obtained.

The heater unit 40 is sandwiched between the first heat absorbing member 49 and the second heat absorbing member 50. Therefore, it is possible to suppress variation in the temperature distribution of the front and back surfaces (the first surface 40*a* and the second surface 40*b*) of the heater unit 40 in the longitudinal direction. Therefore, the heat produced by the heater unit 40 can be distributed.

While certain embodiments have been described, these embodiments have been presented byway of example only, and are not intended to limit the scope of the present disclosure. Indeed, the embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A heating device for an image forming unit, the heating device comprising:

a roller centered on a first center axis;

a heater unit;

a cylindrical film at least partially disposed around the heater unit, the cylindrical film centered on a second center axis, the second center axis parallel to the first center axis;

a support member configured to support the heater unit above the cylindrical film and such that the heater unit is located between the support member and the cylindrical film;

a first heat transfer unit disposed between the cylindrical film and the heater unit and in confronting relation with a first surface of the heater unit; and a second heat transfer unit disposed between the heater unit and the support member and in confronting relation with a second surface of the heater unit, the second surface opposite the first surface;

wherein the heater unit is centered on a third center axis, the third center axis being parallel to a line that intersects the first center axis and the second center axis, and the third center axis being offset from the line such that a sheet fed between the roller and the cylindrical film intersects the line before intersecting the third center axis.

2. The heating device of claim 1, wherein:

the first heat transfer unit has a first thermal conductivity;

the second heat transfer unit has a second thermal conductivity; and the first thermal conductivity is greater than the second thermal conductivity.

3. The heating device of claim 1, wherein:

the first heat transfer unit has a first thermal conductivity;

the second heat transfer unit has a second thermal conductivity;

the heater unit comprises a substrate in confronting relation with the second heat transfer unit, the substrate having a third thermal conductivity;

the first thermal conductivity is greater than the third thermal conductivity; and the second thermal conductivity is greater than the third thermal conductivity.

4. The heating device of claim 1, wherein the heater unit comprises:

a substrate in confronting relation with the second heat transfer unit; and a heating element disposed on the substrate, the heating element in confronting relation with the first heat transfer unit.

5. The heating device of claim 1, further comprising a lubricating layer disposed between the cylindrical film and the first heat transfer unit.

6. The heating device of claim 5, wherein a thickness of the lubricating layer is greater than or equal to 1 μm and less than or equal to 100 μm.

7. The heating device of claim 1, wherein:

the second heat transfer unit has a first contact area with the support member;

the first heat transfer unit has a second contact area with the heater unit; and the first contact area is smaller than the second contact area.

8. The heating device of claim 1, wherein:

the first heat transfer unit is a plate-shaped first heat absorbing member and is centered on a fourth center axis;

the fourth center axis is orthogonal to the second center axis; and the second heat transfer unit is a plate-shaped second heat absorbing member and is structurally separable from the first heat transfer unit.

9. The heating device of claim 1, wherein:

the first heat transfer unit is integrally formed with the second heat transfer unit in a heat absorbing member; and the heat absorbing member has a U-shape that partially extends around the heater unit.

10. An image processing apparatus comprising the heating device of claim 1.

11. A heating device for an image forming unit, the heating device comprising:

a roller centered on a first center axis;

a film centered on a second center axis, the second center axis parallel to the first center axis;

a support separated from the roller by the film;

a heater unit coupled to the support and centered on a third center axis, the third center axis being parallel to a line that intersects the first center axis and the second center axis, and the third center axis being offset from the line such that a sheet fed between the roller and the film intersects the line before intersecting the third center axis;

a first transfer member coupled to at least one of: the support or the heater unit, the first transfer member separating the heater unit from the film; and a second transfer member coupled to at least one of: the support or the heater unit, the second transfer member separating the heater unit from the support.

12. The heating device of claim 11, wherein:

the second transfer member is separated from the first transfer member by the heater unit;

the first transfer member has a first thermal conductivity;

the second transfer member has a second thermal conductivity; and the second thermal conductivity is less than the first thermal conductivity.

13. The heating device of claim 11, further comprising a thermostat coupled to at least one of: the support or the second transfer member, the thermostat configured to determine a temperature of the second transfer member;

wherein the roller comprises:

a cored bar; and an elastic layer extending around the cored bar, the elastic layer separating the cored bar from the film and configured to be compressed against the cored bar.

14. The heating device of claim 11, wherein the heater unit comprises:

a substrate in confronting relation with the second transfer unit;

an insulating layer coupled to the substrate and separated from the second transfer unit by the substrate;

a heating element coupled to the insulating layer and separated from the substrate by the insulating layer; and a protective layer coupled to the heating element and the insulating layer, the protective layer separated from the substrate by the insulating layer.

15. A heating device for an image forming unit, the heating device comprising:

a heater unit comprising:

a substrate;

an insulating layer coupled to the substrate;

a heating element coupled to the insulating layer and separated from the substrate by the insulating layer; and a protective layer coupled to the heating element and the insulating layer, the protective layer separated from the substrate by the insulating layer;

a film extending at least partially around the heater unit;

a first transfer member coupled to the heater unit and separating the heater unit from the film; and a second transfer member coupled to the substrate and separated from the insulating layer by the substrate, the second transfer member being integrally formed with the first transfer member such that a cavity is defined between the first transfer member and the second transfer member;

wherein the heater unit is at least partially disposed within the cavity.

16. The heating device of claim 15, further comprising a thermostat coupled to the second transfer member, the thermostat configured to determine a temperature of the second transfer member.

17. The heating device of claim 15, wherein:

the film is centered on a first center axis;

the heater unit is centered on a second center axis; and the second center axis is orthogonal to the first center axis.

* * * * *